US005584094A

United States Patent [19]

Gurstein

[11] Patent Number: 5,584,094

[45] Date of Patent: Dec. 17, 1996

[54] DUAL-PRESSURE EXTRACTION CLEANER

[75] Inventor: Russell Gurstein, Hayden, Id.

[73] Assignee: U.S. Products, Inc., Hayden Lake, Id.

[21] Appl. No.: 566,035

[22] Filed: Dec. 1, 1995

[51] Int. Cl.[6] ..... A47L 11/34

[52] U.S. Cl. ..... 15/321; 15/339

[58] Field of Search ..... 15/320, 321, 322, 15/339

[56] References Cited

U.S. PATENT DOCUMENTS

| | | | |
|---|---|---|---|
| 3,774,261 | 11/1973 | Colt | 15/321 |
| 3,848,291 | 11/1974 | Morse . | |
| 4,109,340 | 8/1978 | Bates | 15/321 |
| 4,153,968 | 5/1979 | Perkins | 15/321 |
| 5,099,543 | 3/1992 | Wade | 15/321 |

*Primary Examiner*—Chris K. Moore
*Attorney, Agent, or Firm*—Browdy and Neimark

[57] ABSTRACT

An extraction cleaning device is of the type having a cleaning head (60), a vacuum system (70, 80, 90) for applying suction at the cleaning head, a holding tank (10) for holding cleaning liquid, a pump (20) for pressurizing the liquid, and a delivery line for delivering the pressurized liquid to the cleaning head wand, where it is sprayed onto a carpet, upholstery, etc. The device is improved by the addition of a pressure reduction valve, having a calibrated orifice, which is hydraulically connected between the liquid delivery line and a return line to the holding tank. When the reduction valve is open, the delivery line pressure is reduced by the added leakage; this allows switching between high pressure jet spray for carpets and low pressure jet spray for upholstery, drapes, etc. For easy opening and closing of the reduction valve, it is preferably a solenoid valve activated by a switch.

6 Claims, 3 Drawing Sheets

DUAL-PRESSURE EXTRACTION CLEANER

FIELD OF THE INVENTION

The present invention relates to fabric cleaning apparatus for carpets, drapes, upholstery, and the like, particularly cleaning apparatus using vacuum and water or cleaning solutions.

BACKGROUND OF THE INVENTION

Fabrics, rugs, upholstery, and similar articles are often cleaned with devices called "extractors" which wet the item to be cleaned with a cleaning liquid which is then sucked up by vacuum. Such extractors typically include the following elements: a tool acting as a cleaning head (wand) that is systematically moved over the fabric to clean it; a holding tank for containing cleaning liquid (plain water, or other cleaning liquids such as an aqueous solution of detergent, surfactant, etc.); a pump; a delivery line from the tank, through the pump, and to the tool head for spraying cleaning liquid onto the fabric; a vacuum opening on the wand for sucking up cleaning liquid from the object being cleaned; and a vacuum source (such as vacuum cleaner) attached to the cleaning head through a flexible conduit or hose.

Extractor spray head nozzles and pumps should be adapted to spray cleaning liquid with the force appropriate to the item being cleaned. Rugs require a deep penetration and high-velocity sprays, while upholstery should have a low-velocity spray so that underlying layers of foam rubber and backing are not over-wetted. If these underlying layers are over-wetted the cleaning liquid will pick up their dirt and that dirt will be carried up to the fabric surface by the vacuum; the dirt will continue to bleed outward and the outer fabric then cannot be cleaned. Also, the cleaned item will require a long time to dry.

Interchangeable cleaning heads may be provided for various different items which require different penetration depths. The different heads may include different nozzle patterns or total nozzle orifice areas.

Because of the different levels of spray force needed for various items, extractors have been designed to provide adjustable spray force levels. Extractors are divided generally into to classes: high-pressure and low-pressure.

The low-pressure type (delivery line pressures up to about 100 psi) typically uses an on-demand diaphragm pump. The pump will run whenever a trigger switch is thrown by the user, or, when a pressure sensor senses a drop caused by a trigger spray valve. An on-demand pump system requires no bypass valve from the delivery line back to the holding tank; all the cleaning liquid sucked from the holding tank goes directly out of the spray head. A diaphragm pump is not a positive-displacement type of pump.

A high-pressure extractor (over 100 psi delivery line pressure) typically uses a positive-displacement pump, such as a piston pump. Due to their heavier construction and the added inertia of the flywheel, these pumps are not easy to start and stop and a simple switch of the power from abruptly on to off is not satisfactory. When the user triggers the spray head on and off, the pressure in the delivery line must somehow be compensated, and pressure spikes caused by liquid surges allowed for. Pressure in the cleaning fluid delivery line can become too high from surge, or during steady spraying if there is any slight variation in the liquid or minor clogging due to dirt.

High-pressure extractors all use a bypass valve in the delivery line, downstream of the pump, to lower the pressure by bleeding cleaning fluid back into the holding tank when the trigger spray valve is closed; otherwise the flow would be blocked and the delivery line pressure would become excessive. To provide different spray head pressures, the prior-art extractors use two different systems. Either the bypass valve is adjusted, or, the motor speed is adjusted.

The high-pressure pumps are driven by an electric motor of either the AC or the DC type.

AC motors cannot be run at different speeds because they turn with the constant 60-Hz cycles of line voltage (unless they use a very sophisticated motor speed control). A positive-displacement pump delivers a positive amount of liquid, and this liquid must always be going somewhere when the pump is running or the pump will lock up. A non-positive displacement type of pump does not deliver a positive amount of liquid, by design; therefore, the more hydraulic resistance this type of pump sees, the lower the actual pressure and flow that will come out of the tip of the cleaning tool spray head.

Thus, it is possible to use an AC motor in a high-pressure extractor with a positive-displacement pump, but the spray head pressure can only be varied by adjusting the bypass valve relief pressure setting. In order to vary the pressure by varying the motor speed, a special AC power supply that rectifies the line current and then generates AC at a desired frequency must be used; however such units are complex and very expensive, adding up to $300 to the manufacturing cost.

A DC motor will run efficiently at any desired speed and therefore can efficiently pump liquid at any rate when driving a positive-displacement pump, but it must be supplied with a variable voltage. Variable-voltage sources for DC motors are well-known and practical, but they are expensive because of the high-power capacity variable-voltage power supply that is needed. (A DC power supply is roughly the first half of a variable-frequency AC supply, so it costs less but it is still quite costly.) A typical DC power supply includes a control potentiometer that control the cut-off voltage of a bank of SCR's (silicon controlled rectifiers) which "chop" line AC before it is rectified, to control the average voltage fed to the motor. The control circuitry, high-wattage SCR's, and heavy-duty rectifier are not only costly but also consume energy that is thrown off as heat, and of course are liable to malfunction. In addition, a DC motor alone is more expensive than an AC motor of equivalent power.

Because of the expense of varying the motor speed to control the delivery line pressure, another method is often used. An AC motor runs at constant speed and delivers a constant-volume flow, and excess volume is diverted back to the holding tank through a spring-loaded bypass valve. The bypass valve is typically spring-loaded (pressure-activated) piston valve. The spring-loaded piston slides to-and-fro in a cylinder; when pressure is low, the piston is urged forward by the spring to a position in which it blocks return flow to the holding tank; when pressure rises, the piston forces the spring back, uncovering the return-flow orifice. Thus, as the user trigger the spray head and the delivery line pressure jumps up and down, the bypass valve compensates and maintains an even pressure while the motor turns at a constant speed.

The drawback of manually adjusting a bypass valve is that is must be easily accessible. If located inside the housing, the housing must be opened each time that the valve is adjusted;

this puts the operator in a potentially hazardous position, since the valve is usually adjusting with the machine on. If located so that the adjusting portion is outside the housing, the valve is liable to freezing and damage during use or transport. Manual adjustment of a conventional bypass valve requires the use of tools. Moreover, continual adjustment of the bypass valve will reduce its life and performance.

There is also the concern that the operator will exceed the factory setting, which would prematurely wear out the pump and motor; depending on how far past the factory setting the adjustment were pushed, the gauge hoses and heat exchanger could also be damaged. Conversely, if the pressure is adjusted too low the adjustment nut may actually be unscrewed causing the cleaning liquid to go everywhere and the piston and spring to be lost. Loss of the nut can also occur due to the operator's failure to properly lock it in place with the lock nut that is provided to prevent loosening due to vibration. Tightening of the lock nut also requires the use of tools in most cases.

The problems of adjusting a manual bypass valve limit the usefulness of prior-art high-pressure extractors. Deep-penetration, high-velocity spray items like carpets and shallow-penetration, low-velocity spray items like upholstery cannot be alternately cleaned with the same extraction machine. The user cannot readily adjust the delivery line pressure between the higher pressure needed for carpets and the lower pressure needed for upholstery.

The user might also want to quickly adjust the pressure when mounting various interchangeable spray heads on the wand, or for other reasons.

The prior art does not disclose any simple, foolproof, and inexpensive apparatus for easily and quickly switching cleaning fluid delivery pressures in an extraction-type cleaner.

SUMMARY OF THE INVENTION

Accordingly, the present invention has an object, among others, to overcome deficiencies in the prior art such as noted above. In particular, the present invention provides easy and quick switching of cleaning fluid delivery pressures in an extraction-type cleaner with an inexpensive apparatus.

In addition to conventional extractor elements, the present invention provides a valve that is quickly and easily operable between two states, a closed state in which no cleaning liquid can pass through it and an open state in which a metered amount of cleaning liquid bleeds from the delivery line back to the holding tank, reducing the delivery line pressure. In the preferred form of the invention the pressure reduction valve is solenoid-operated. Such solenoid-operated valves are commercially available.

The pressure-reduction valve is placed in parallel with the conventional bypass valve.

When the user is spraying cleaning liquid from the spray head of the wand, and the reduction valve of the invention is opened, the line pressure will drop below the bypass cut-in pressure and the bypass valve will close. At this point the AC motor and the pump will supply a constant volume of liquid into the delivery line, which can exit via the spray head and the calibrated orifice of the solenoid-operated pressure reduction valve. The result is a constant but reduced pressure, which is suited to upholstery, drapes, or partitions.

That is, the auxiliary bleed orifice area of the reduction valve may be chosen so that its additional area causes a calibrated pressure drop in the delivery line which immediately adjusts the force of the cleaning liquid spray from the cleaning head to the lower force adapted for upholstery, drapes, and partitions.

BRIEF DESCRIPTION OF THE DRAWING

The above objects and the nature and advantages of the present invention will become more apparent from the following detailed description of embodiments taken in conjunction with drawings, wherein.

DETAILED DESCRIPTION OF THE PREFERRED EMBODIMENTS

Figure 1:
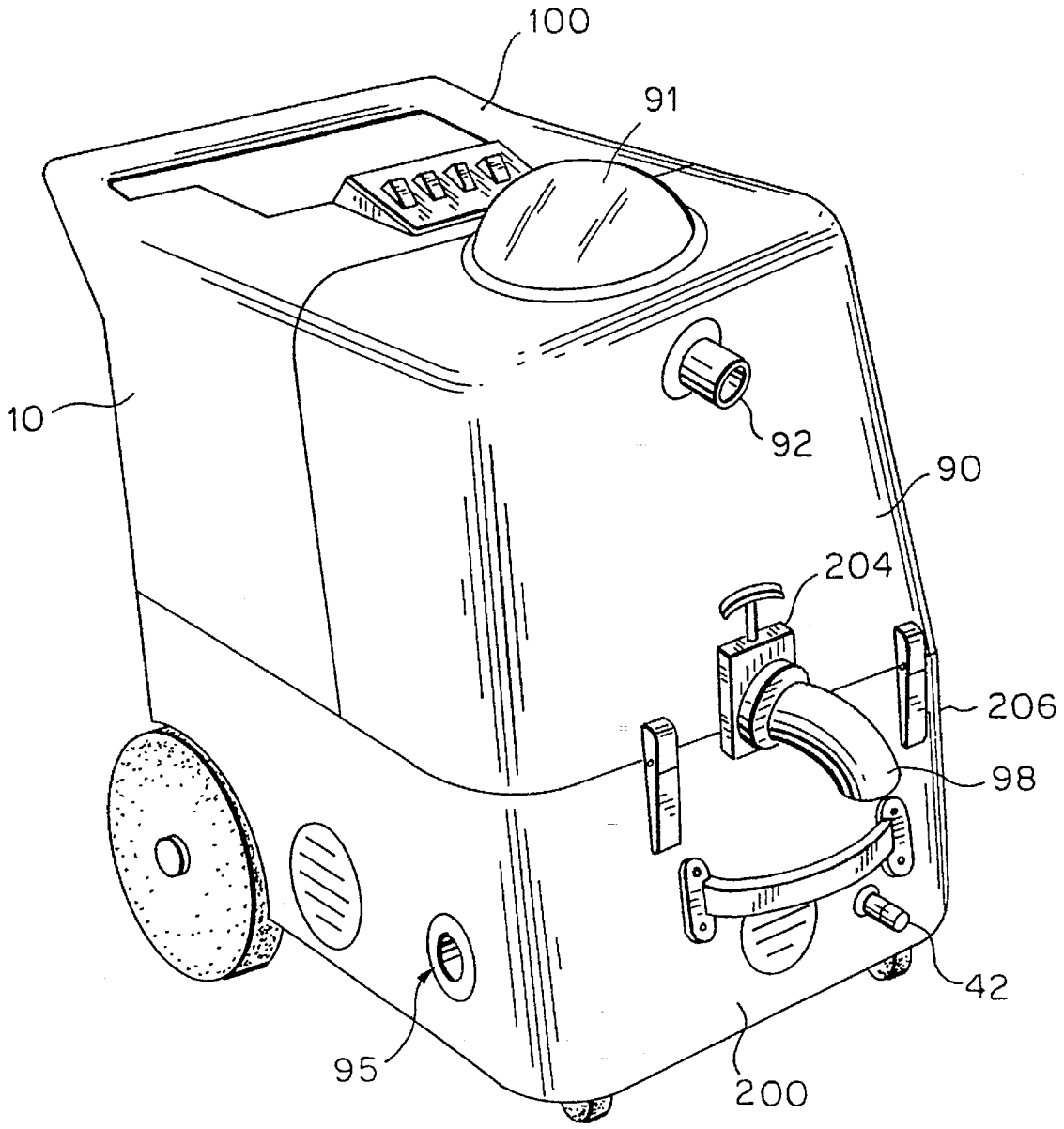
FIG. 1 is a perspective view of a particular extractor including the present invention.

FIG. 1 shows an extractor or extraction cleaning machine housing, exemplary of the best mode of the invention. The housing includes a wheeled base 200, a holding tank 10 for cleaning liquid, and a recovery tank 90 for dirty recovered cleaning liquid. The cleaning liquid may be of any conventional sort. The two tanks 10 and 90 bolt together and are removably fastened to the base 200 with clasps 206.

The housing includes a bank of electrical switches 100, a vacuum blower exhaust port 95, a recovery tank viewing window 91, and a recovery tank discharge 98 for emptying dirty, recovered cleaning liquid, as well as equipment such as vents, handles, and a power cord (not shown).

Figure 2:
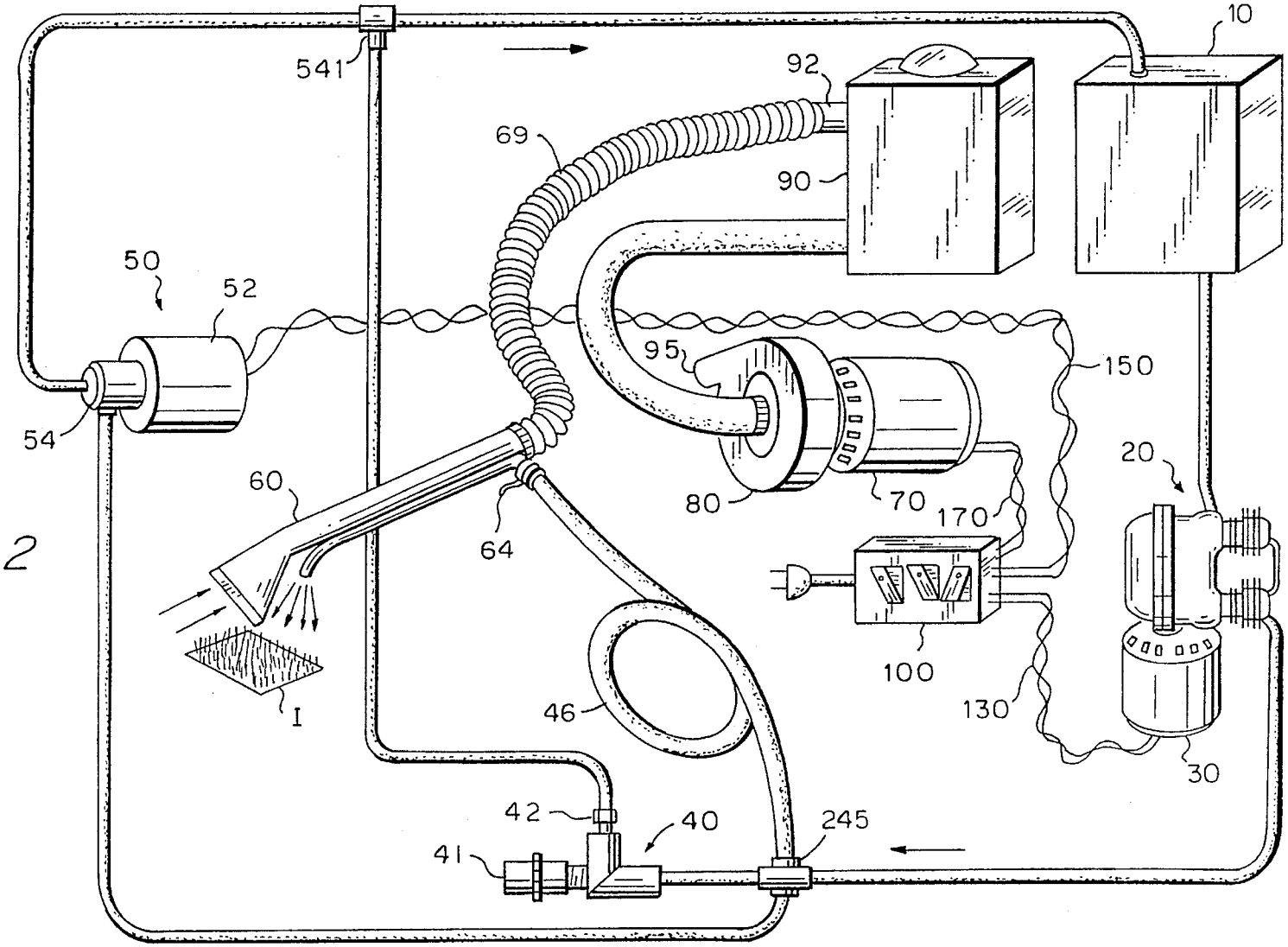
FIG. 2 is a schematic view of the present invention.

Various attachments, not shown in FIG. 1, are connected to the housing for extraction cleaning use; these attachments are pictured in FIG. 2. Among these are a flexible suction (vacuum) hose 69, which attaches to coupling 92 (shown in FIG. 1) and a flexible cleaning liquid pressure hose 46, which attaches to the coupling 42 (shown in FIG. 1). As shown in FIG. 2, the hoses 69 and 46 are joined distal the housing to a wand, which is manipulated for extraction cleaning with the machine of FIG. 1. The wand both jet-sprays cleaning liquid onto an item I that is to be cleaned, and also vacuums the liquid off. The jet-spray is controlled by the operator with a hand trigger valve 64.

The internal parts of the invention are shown in FIG. 2. Cleaning liquid holding tank 10 feeds liquid to a positive-displacement, high-pressure, multi-cylinder pump 20, from which the liquid, pressurized at about 100–300 psi, is sent on to the piping junction 245. The pump 20 is powered by an electric motor 30. The motor 30 is powered through wires 130 from switch bank 100 having various on/off power switches for the various electrical parts. The bank 100 draws line current through a plug.

The motor 30 is preferably, for low expense, an AC motor whose speed is constant and which therefore pumps at a constant flow rate, i.e., a certain number of gallons per minute. If the flow is obstructed, the motor 30 will increase its torque and increase the pressure produced by the pump 20.

At the pipe junction 245 the liquid flow splits. One flow goes to a bypass valve 40, which regulates pressure in the line between the pump 20 and bypass valve 40. The pressure may vary when, for example, the operator closes and opens the trigger valve 64. The liquid passes through the flexible hose 46 to the trigger valve 64 and to the end of the wand 60.

The delivery line of the cleaning liquid includes all the piping and tubing between the pump 20 and the spray head of the wand 60.

The line pressure is regulated by bleeding off liquid, when the pressure becomes too great, through an adjustable spring-loaded piston relief valve portion of the relief valve 40; the bypassed flow passes to the pipe junction 541 and thence back to the holding tank 10. A rotary screw adjustment 41 changes the piston-loading spring compression to adjust the bleed cut-out pressure.

After the liquid is jet-sprayed onto the item I it is sucked up by a vacuum recovery system including the wand 60, hose 69, recovery tank 90, blower 80, and blower motor 70. The motor 70 is powered through wires 170.

All of the above-listed elements can be found in conventional extractors, except for the pipe junctions 245 and 541. These junctions create a second cleaning liquid pathway, parallel to the bypass flow through the bypass valve 40 to the holding tank 10. In this pathway is a solenoid-operated pressure reduction valve 50, which is a novel element in the present invention.

The reduction valve 50 is preferably electrically operated, but may also be operated by levers, handles, mechanical linkages, hydraulic power, or any other kind of actuator. The valve 50 of FIG. 2 is operated through wires 150 from a switch of switch bank 100, which sends current into a solenoid portion 52 of the solenoid valve; the solenoid 52 opens and closes a valve portion 54.

Figure 3:
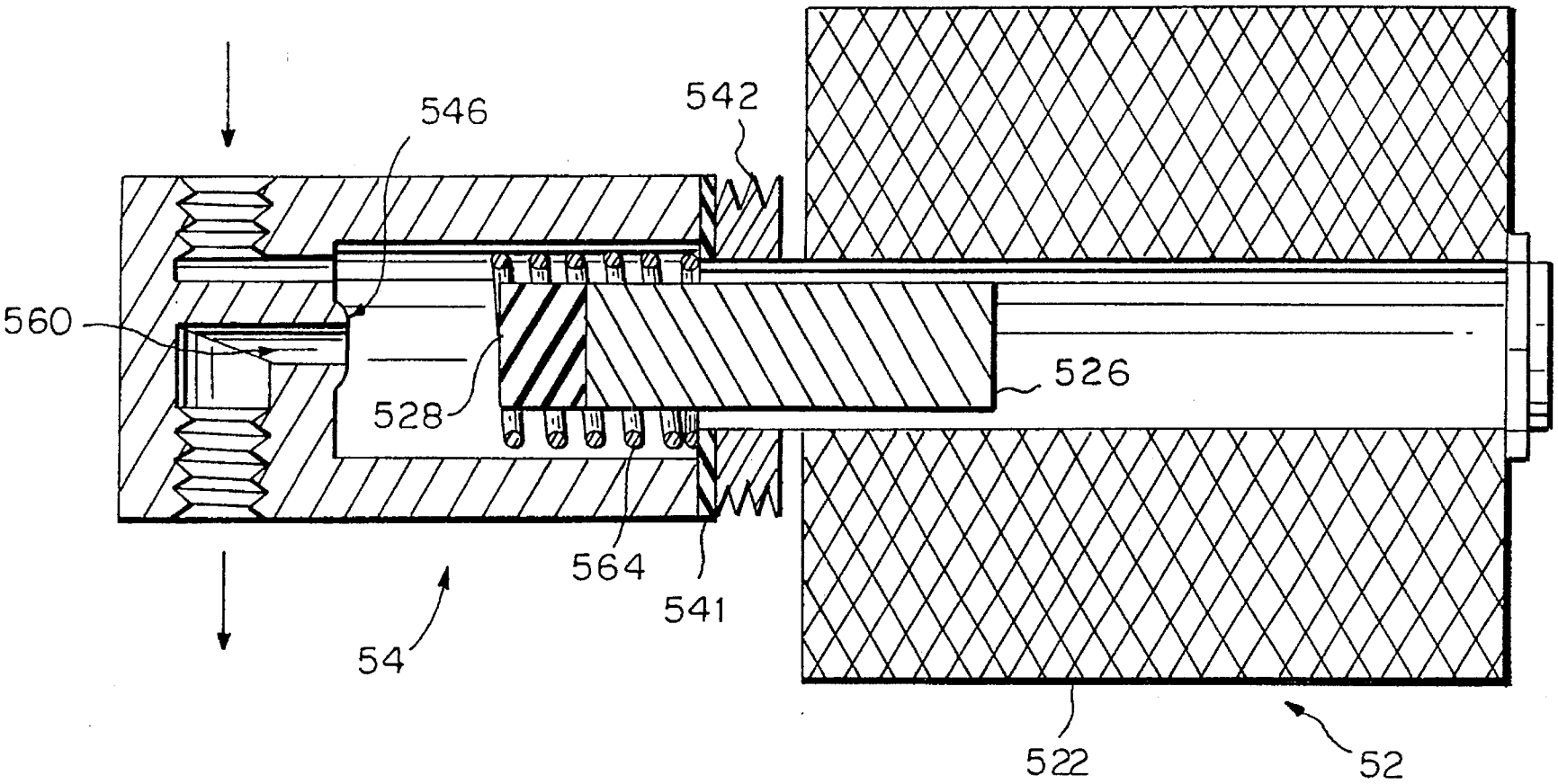
FIG. 3 is a cross-sectional view of the solenoid valve of the invention.

FIG. 3 shows the solenoid reduction valve in detail. The solenoid portion 52 includes an electromagnet winding (coil) 522 surrounding a slug 526, which may be of soft iron or other ferromagnetic material. The winding conducts AC current when the solenoid switch is thrown at the switch bank, creating a magnetic field which pulls the iron slug 526 to the right in FIG. 3, compressing a valve-closing spring 564 and retracting the rubber seal 528 that is inserted in the end of the slug 526 away from the seat 546 of the valve portion 54. This opens the valve, permitting cleaning liquid to flow, as indicated by the arrows in FIG. 3, into the internal chamber of the valve portion 54 and out through the calibrated orifice 560. This drops the delivery line pressure by an amount that is roughly proportional to the area of the orifice 560. When the switch is opened and no current flows in the solenoid winding 522, the spring 524 closes the valve. A rubber gasket 541 and a threaded lock nut 542 from the solenoid coil to the valve section are provided for sealing and adjustment.

Solenoid valves such as that of FIG. 3 are commercially available. One such valve is model no. S311AFO2V8AC5 made by GC Valves.

The effect of the calibrated orifice is to introduce an additional leakage into the flow of the liquid, which causes a pressure drop. When the trigger valve 64 is opened and cleaning liquid is spraying from the wand 60, the bypass valve 40 moves toward the closed position so that most of the flow passes directly from the pump 20 to the wand 60. If the reduction valve 50 is then opened, the pressure drops due to the extra leakage of the orifice 560. By choosing the orifice 560 area correctly, the delivery line pressure can be dropped to any desired value. The bypass valve 40 will not affect the line pressure at the wand as long as the trigger valve 64 is open; when it is closed, the bypass valve will operate to prevent excess pressure whether the reduction valve 50 is open or closed.

The invention provides an apparatus for providing a second calibrated cleaning liquid delivery line pressure for two levels of jet spray force and penetration. It uses off-the-shelf components and is simple, inexpensive, and easily-implemented. It is an advance over the prior-art methods of adjusting a bypass valve or adjusting a pump motor speed.

The foregoing description of the specific embodiments will so fully reveal the general nature of the invention that others can, by applying current knowledge, readily modify and/or adapt for various applications such specific embodiments, without departing from the generic concepts, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. In an extraction cleaning device of the type having a cleaning head, a vacuum system for applying suction at the cleaning head, a holding tank for holding cleaning liquid, a pump for pressurizing the liquid, and a delivery line for delivering the pressurized liquid to the cleaning head for spraying the cleaning liquid onto an item to be cleaned; the improvement comprising:

a pressure reduction valve, the reduction valve including a calibrated orifice, the reduction valve being hydraulically connected between the delivery line and a return line to the holding tank, the reduction valve having an open position and a closed position; and means for opening and closing the reduction valve.

2. The improvement according to claim 1, wherein the means for opening and closing the reduction valve includes a solenoid.

3. The improvement according to claim 2, wherein the means for opening and closing the reduction valve includes an electrical switch for selectively activating the solenoid.

4. The improvement according to claim 3, wherein the device includes a housing and the improvement includes the switch being mounted on the housing.

5. The improvement according to claim 1, wherein the device includes a bypass valve and the improvement includes the reduction valve being hydraulically in parallel with the bypass valve.

6. The improvement according to claim 1, wherein the device includes an electric motor for driving the pump and the improvement includes the motor being an AC motor.

* * * * *